United States Patent [19]

Martin

[11] 3,967,703

[45] July 6, 1976

[54] EMERGENCY BRAKE FOR RACK AND PINION HOIST

[75] Inventor: Derek John Martin, Ware, England

[73] Assignee: D. Wickham and Company Limited, England

[22] Filed: Oct. 24, 1974

[21] Appl. No.: 517,616

[30] Foreign Application Priority Data

Oct. 24, 1973 United Kingdom ..... 49568/73

[52] U.S. Cl. ..... 187/78; 187/67; 187/68; 187/89

[51] Int. Cl.[2] ..... B66B 5/04; B66B 5/16; B66B 5/28

[58] Field of Search ..... 187/19, 67, 68, 73, 187/77, 78, 80, 89, 89.90, 91; 188/189

[56] References Cited

UNITED STATES PATENTS

| | | | |
|---|---|---|---|
| 716,949 | 12/1902 | Slevin | 187/90 |
| 755,736 | 3/1904 | Blanding | 187/90 |
| 805,818 | 11/1905 | Regina | 187/89 |
| 839,327 | 12/1906 | Small | 187/91 |
| 885,560 | 4/1908 | Worthington | 187/78 |
| 950,477 | 3/1910 | Courtois | 187/89 X |
| 1,169,015 | 1/1916 | Drawbaugh | 187/90 |
| 1,196,260 | 8/1916 | Mayfield | 187/90 |
| 1,844,133 | 2/1932 | Maniscalco | 187/89 X |

FOREIGN PATENTS OR APPLICATIONS

| | | | |
|---|---|---|---|
| 1,456,341 | 11/1968 | Germany | 187/89 |

*Primary Examiner*—Richard A. Schacher
*Assistant Examiner*—James L. Rowland
*Attorney, Agent, or Firm*—Stewart and Kolasch,Ltd.

[57] ABSTRACT

A rack-and-pinion type hoist has an improved braking apparatus that includes a spring buffer, preferably hydraulic, carried by the cage of the hoist, a rotatable shaft also carried by the cage and positively engaged with a member extending along the mast so as to be driven in rotation by movement of the cage along the mast and connecting means for engaging the shaft and the buffer comprising a centrifugal governor driven by rotation of the shaft and operating, in response to rotation of the shaft in excess of a pre-determined rate of rotation, to provide positive drive to a linearly movable member, the movement of which is opposed by the buffer.

7 Claims, 4 Drawing Figures

EMERGENCY BRAKE FOR RACK AND PINION HOIST

The present invention relates to hoists, in particular to rack-and-pinion type hoists and to braking apparatus for use in this type of hoist.

A rack-and-pinion type hoist is a hoist in which the cage of platform, hereinafter referred to simply as the cage, climbs a mast of the hoist by means of a driven pinion carried by the cage which pinion is engaged with a rack extending along the mast.

Existing braking apparatus for rack-and-pinion type hoists is either of the instantaneous type, in which operation of the braking apparatus stops movement of the cage instantaneously, but at the cost of stress, and possible damage, to the hoist mechanism, or of the gradual type, in which the distance travelled by the cage after the brake is applied is variable and depends on the load on the cage.

It is an object of the present invention to provide an improved braking apparatus for use with a rack-and-pinion type hoist.

According to the present invention there is provided a rack-and-pinion type hoist having braking apparatus comprising a spring buffer carried by the cage of the hoist, a rotatable shaft also carried by the cage and positively engaged with a member extending along the mast so as to be driven in rotation by movement of the cage along the mast and connecting means for engaging the shaft and the buffer comprising a centrifugal governor driven by rotation of the shaft and operating, in response to rotation of the shaft in excess of a predetermined rate of rotation, to provide positive drive to a linearly movable member, the movement of which is opposed by the hydraulic buffer.

The spring buffer is preferably a hydraulic buffer, though in the case of small hoists a suitably rated spring may be used.

The braking apparatus preferably includes a member mounted for free rotation on the shaft and adapted to be drivingly engaged by the centrifugal governor on operation of the latter, which member includes means engaging it with the said linearly movable member.

The member on the mast with which the shaft is positively engaged may be a rack and this rack is advantagously the main climbing rack of the hoist. The shaft preferably has a fixed pinion engaging it with the rack.

Similarly, the said linearly movable member may be a rack. In this case, the centrifugal governor, on operation, positively engages a member mounted for free rotation on the shaft, which member has a pinion engaged with the movable rack.

An embodiment of the invention will now be described by way of example with reference to the accompanying drawings, in which.

Figure 1:
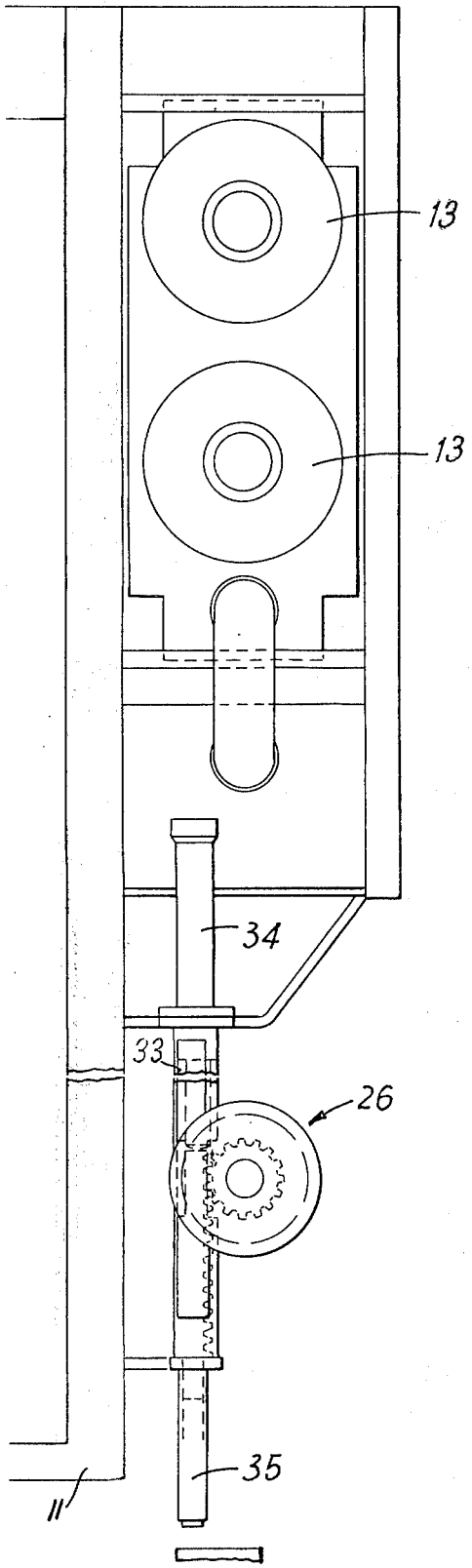
FIG. 1 is a schematic side view of part of a rack-and-pinion type hoist embodying the invention.
Figure 2:
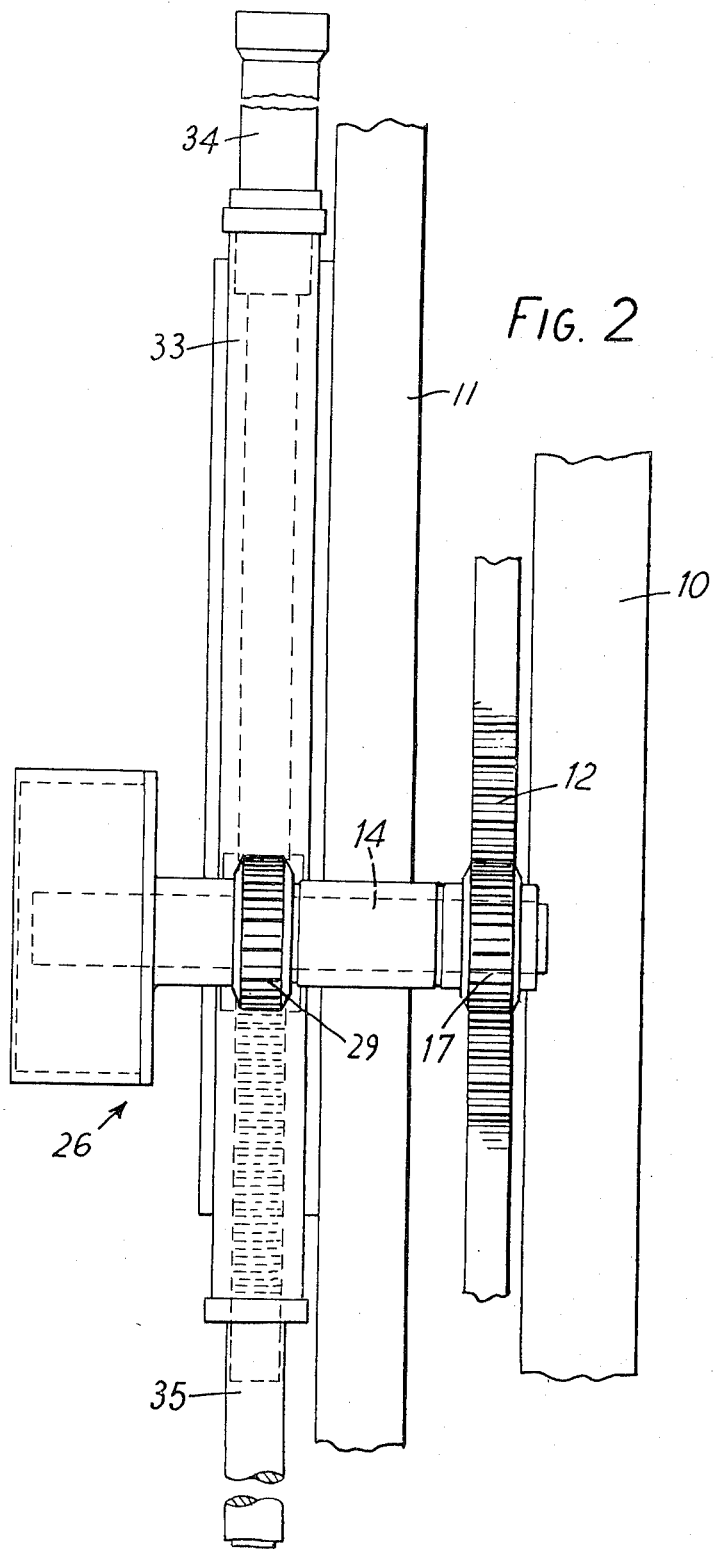
FIG. 2 is a further schematic view of the part of the hoist shown in FIG. 1, taken from the rear.
Figure 3:
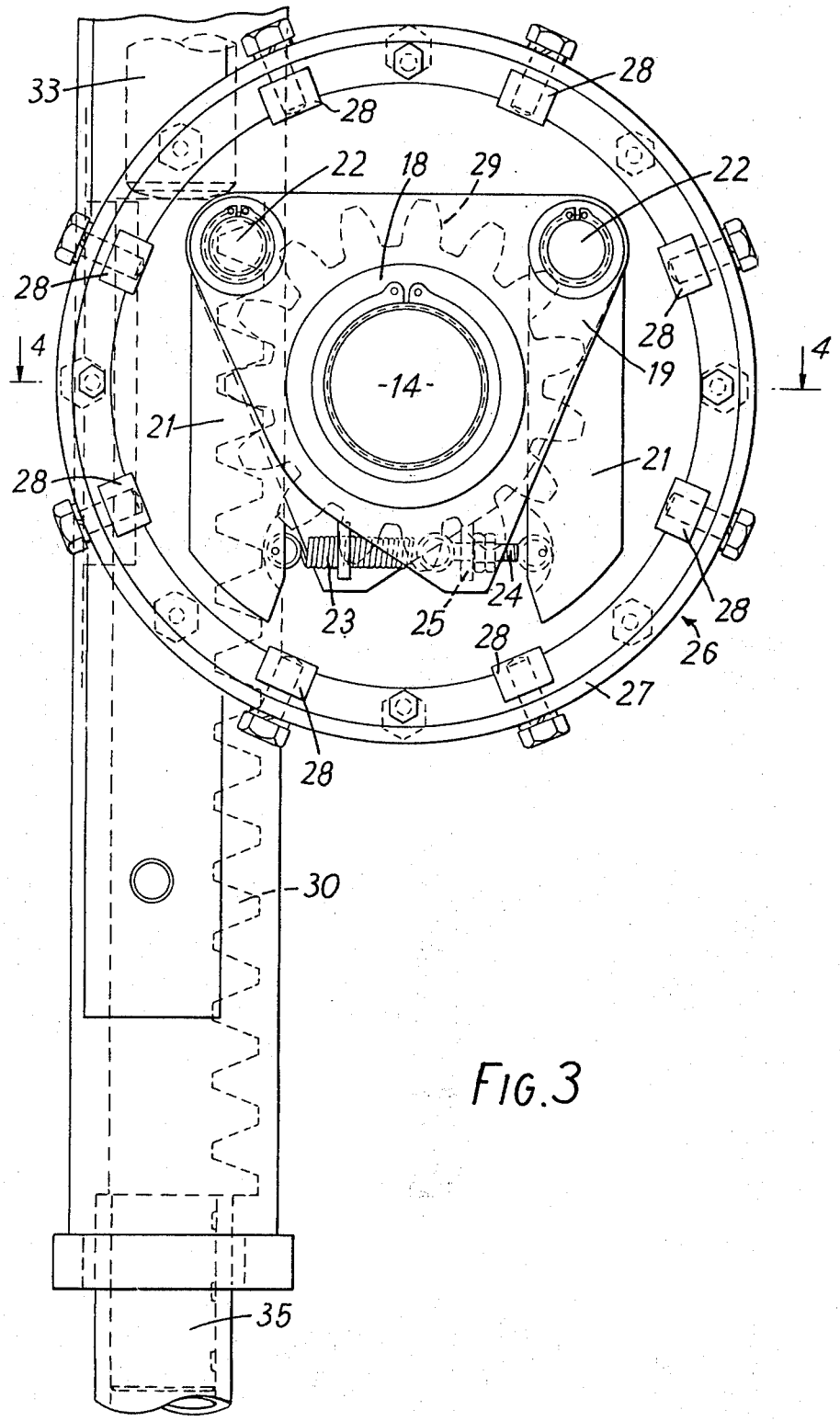
FIG. 3 is a more detailed side view of the part of the hoist shown in FIGS 1 and 2.
Figure 4:
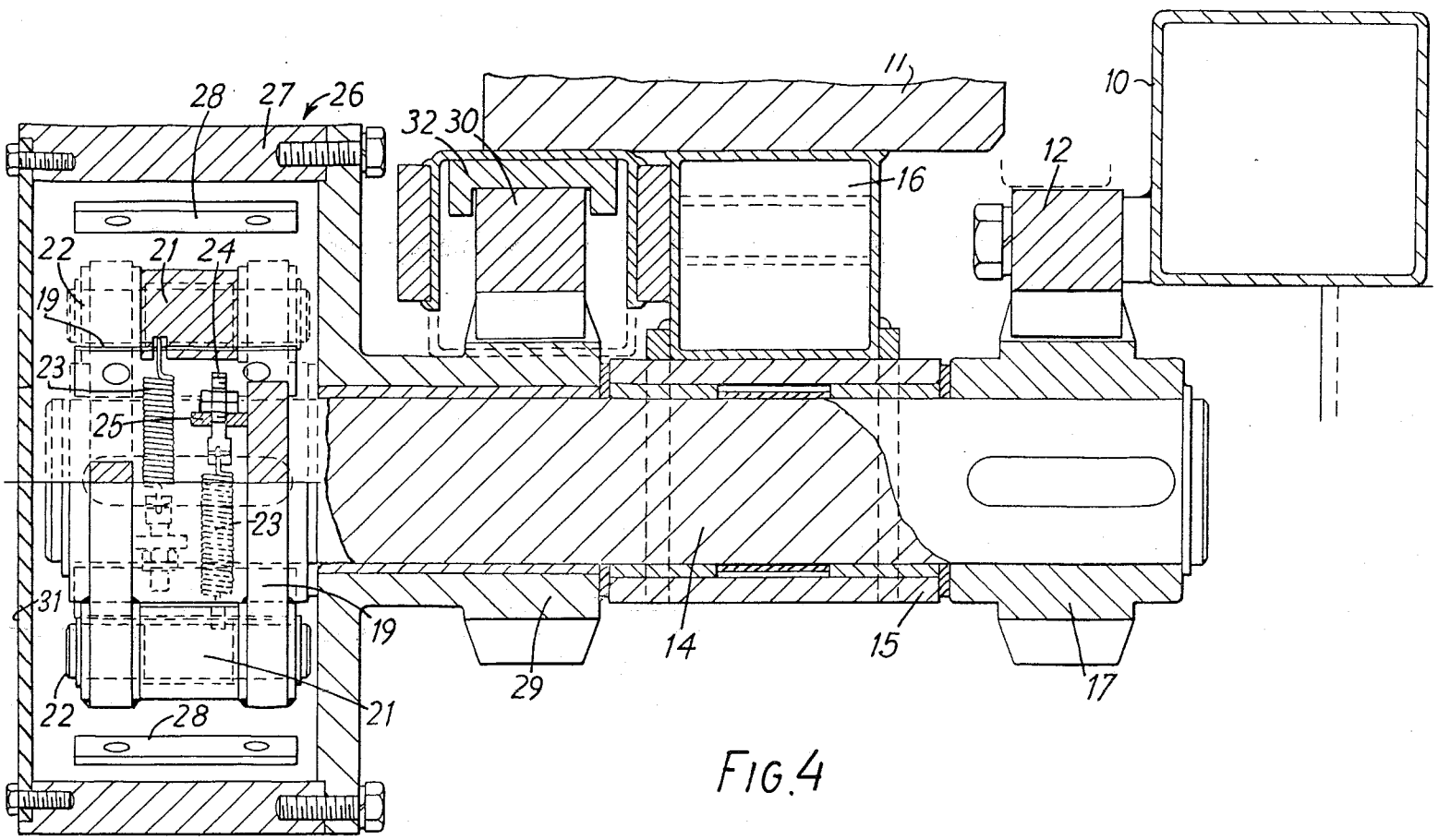
FIG. 4 is a horizontal section on the line IV–IV of FIG. 3.

The hoist comprises a vertically extending mast 10 and a cage 11 adapted to travel vertical along the mast. The mast carries a vertically extending climbing rack 12 and pinions (not shown) carried by the cage 11 and driven by hoist motors 13 are engaged with the climbing rack 12. Rotation of the pinions by the motors 13 causes the cage 11 to move along the mast.

The cage 11 also carries an emergency braking device. This comprises a horizontal shaft 14 rotatably mounted in bearings 15 secured in a support frame 16 fixed to the cage 11. One end of the shaft 14 is rigidly attached to a pinion 17 which is positively engaged with the climbing rack 12 of the hoist. Positive engagement ensures that the shaft can only move relative to the rack upon rotation of the shaft: there can be no sliding movement. The other end of the shaft 14 carries a yoke 18 which rotates with the shaft 14. The yoke 18 comprises approximately triangular plates 19 between which are supported two bobweight sprags 21, each of which is pivotally connected at one of its ends to the yoke 18 by an associated pin 22. The sprags 21 can rotate about the pins 22 and are restrained from moving radially outwardly with respect to the axis of the shaft 14 by respective tension springs 23. Each tension spring 23 is connected at the end remote from the associated pin 22 to one of the sprags 21, and at its other end to a bolt 24 secured to a flange 25 extending from one of the plates 19 of the yoke 18.

The said other end of the shaft 14 also supports a drum-and-pinion assembly 26, which is concentrically mounted and freely rotatable on the shaft 14. The drum 27 of the assembly 26 carries an annular array of abutment blocks 28 and the pinion 29 of assembly 26 is engaged with a rack 30. The end wall 31 of the drum 27 is transparent. The rack 30 is of short length and is free to move vertically with respect to the cage 11, while being restrained from movement in other directions by a vertical channel-sectioned guide 32 fixed to the support frame 16 of the cage 11.

Immediately above the rack 30 is the lower end of a piston rod 33 of an hydraulic buffer 34 carried by the cage 11. The hydraulic buffer 34 is a commercially available hydraulic shock absorber comprising a hollow tubular piston mounted for reinforced movement within a hydraulic-fluid-containing cylinder. When the piston is depressed, fluid is metered into the interior of the hollow piston which also accomodates a spring for repositioning the piston.

The rack 30 has connected to its lower end a leg 35, the purpose for which will be described later.

The operation of the emergency brake will now be described: in normal operation of the hoist the shaft 14 is driven in rotation by the pinion 17 engaged in the climbing rack 12 when the cage 11 moves vertically on the mast. The sprags 21 which, because of the way in which they are mounted, tend to swing outwardly when the shaft 14 rotates are, at normal operating speeds, restrained from moving outwardly by the springs 23. As the speed of vertical downward movement of the cage 11 increases, so does the speed of rotation of the shaft 14, which is proportional to it. If the speed of rotation of the shaft 14 increases beyond a pre-determined amount, the centrifugal forces acting on the sprags 21 overcome the force of the springs 23 and the sprags 21 move outwardly and one of them comes into driving engagement with the abutment blocks 28. The engagement causes the drum-and-pinion assembly 26 to rotate, thus driving upwards the slideable rack 30 engaged with the pinion 29 of the assembly 26.

The upward movement of the rack 30 is opposed by the piston rod 33 of the hydraulic buffer 34. The buffer 34 is so arranged that on initial contact between the piston rod 33 and the rack 30 zero resistance to upward movement of the rack 30 is offered, so that no shock is presented to the hoist mechanism. The buffer 34 is so valved that depression of the piston rod 33 builds up resistance in the buffer 34 rapidly so that the rack 30 is quickly brought to a halt.

The buffer 34 in turn halts downward movement of the cage 11, because of the driving engagement from the rack 30 to pinion 29, blocks 28 to sprag 21 and pinion 17 to climbing rack 12.

The buffer 34 also acts to halt the downward movement of the cage 11 should it over-run the lower extent of its intended downward travel. As the cage 11 approaches the ground, or other obstructing surface, the downwardly projecting leg 35 comes into contact with that surface. The piston rod 33, which it will be recalled is mounted on the cage 11, is forced back and the cage 11 is brought to a halt.

After the emergency brake has operated, the apparatus can be re-set for normal operation extremely simply: the cage 11 is driven upwardly a small amount, thus releasing the sprag 21 from engagement with the blocks 28, whereupon the springs 23 will retract the sprag 21, the piston rod 33 and the movable rack 30 return automatically, to their normal positions.

The transparent end wall 31 of the drum 27 enable the essential governor components, which are susceptible to deterioration, to be visually inspected at all times without disassembly of the apparatus.

It will be noted that two sprags 21 are provided, although only one will engage with the blocks 28 for each direction of rotation of the shaft 14. The reason why the two sprags 21 are provided, catering for both clockwise and anticlockwise rotation of the shaft 14, is that hoists are frequently supplied as twin units in which two cages operate on a common mast for handling the cages. The arrangement of two sprags avoids the need to manufacture individual left-hand and right-hand emergency brake assemblies; the apparatus described may be fitted to either of a pair of cages.

I claim:

1. A rack-and-pinion hoist comprising a mast, a cage adapted to travel along said mast, and containing pinion means, means for driving said pinion means, a first rack extending along the mast and in engaging relationship with said pinion means, a braking apparatus comprising a second, vertically extending rack, a hydraulic piston-and-cylinder buffer means, and a rotatable shaft means carried by said cage, said rotatable shaft being positively engaged with said first rack and thereby driven in rotation by the movement of the cage along said mast, and connecting means for engaging the shaft and the buffer means, said connecting means comprising a centrifugal governor driven by the rotation of the shaft and operating in response to a rotation of the shaft in excess of a predetermined rate of rotation to provide positive drive to said second rack, said second rack being vertically movable and having an upper end which, when the second rack is driven upwardly, contacts and depresses the piston of the buffer means, whereby movement of the second rack is initially opposed and then prevented and a braking force is applied to the shaft and hence to the cage.

2. A hoist according to claim 1 wherein the braking apparatus includes a member mounted for free rotation on the shaft and adapted to be drivingly engaged by the centrifugal governor on operation of the latter, which member includes means engaging it with the said second rack.

3. A hoist according to claim 2 wherein the said first rack is the main climbing rack of the hoist.

4. A hoist according to claim 1 wherein the centrifugal governor, on operation, positively engages a member mounted for free rotation on the shaft, which member has a pinion engaged with the second movable rack.

5. The rack-and-pinion hoist of claim 1, wherein the rotatable shaft is provided at one end with a fixed pinion means which is in positive engagement with the first rack.

6. The rack-and-pinion hoist of claim 1, wherein the means for driving said pinion means is a motor means.

7. A rack-and-pinion hoist comprising a cage and a mast, said cage being mounted for vertical movement on said mast, a first, vertically extending climbing rack carried by said mast, said cage containing pinion means which are in engaging relationship with said first climbing rack, means for driving said pinion means and causing said cage to move along said mast and an emergency braking apparatus comprising a second, vertically extending rack, a hydraulic piston-and-cylinder buffer means and a rotatable shaft means carried by said cage, one end portion of said shaft being provided with a fixed pinion means which is in engaging relationship with the first climbing rack, the other end of said shaft being provided with a yoke means which rotates with said shaft and is provided with engaging means and a drum-and-pinion assembly, said drum-and-pinion assembly containing abutment surfaces and also connected to pinion-engaing means for engagement with said second rack, whereby upon rotation of the shaft in excess of a predetermined rate of rotation, the engaging means of the yoke engages the abutment surfaces of the drum-and-pinion assembly, causing said assembly to rotate, which in turn, rotates the pinion-engaging means which is in engagement with said second rack, said second rack having an upper end which, when the second rack is driven upwardly, contacts and depresses the piston of the buffer means, whereby movement of the second rack is initially opposed and then prevented and a braking force is applied to the shaft and thus to the cage.

* * * * *